US006524225B1

(12) United States Patent
Arias

(10) Patent No.: US 6,524,225 B1
(45) Date of Patent: Feb. 25, 2003

(54) MAXILLARY OCCLUSION MUSCLES-EXERCISER, CHEEK MUSCLES-EXERCISER, CHEEK AND MOUTH MUSCLES-EXERCISER

(76) Inventor: Christian Arias, Edificio Centro Colon, Oficina #6-10, San Jose (CR)

( * ) Notice: Subject to any disclaimer, the term of this patent is extended or adjusted under 35 U.S.C. 154(b) by 0 days.

(21) Appl. No.: 09/454,847

(22) Filed: Dec. 7, 1999

(51) Int. Cl.[7] ..... A63B 23/03; A61H 1/00; A61H 1/02

(52) U.S. Cl. ..... 482/11; 601/38

(58) Field of Search ..... 602/17, 902, 18; 482/11, 121, 130; 128/859, 848, 861, 862; 601/38, 139; D24/180, 194; D21/406; 446/419, 421, 15; 606/234–235; 433/2

(56) References Cited

U.S. PATENT DOCUMENTS 1,618,189 A * 2/1927 Hansen
D113,655 S * 3/1939 Davis
2,172,998 A * 9/1939 Grout et al. ..... 128/62
D159,667 S * 8/1950 Ross ..... D34/15
3,528,655 A * 9/1970 Ruderian ..... 272/82
4,883,072 A * 11/1989 Bessler ..... 128/857
4,944,313 A * 7/1990 Katz ..... 128/859
5,413,095 A * 5/1995 Weaver ..... 128/200.26
5,413,547 A * 5/1995 Cole et al. ..... 482/121
5,782,868 A * 7/1998 Moore, Jr. et al. ..... 606/235
6,179,864 B1 * 1/2001 Peters-Combs ..... 606/234

* cited by examiner

*Primary Examiner*—Denise Pothier

(57) ABSTRACT

A jaw, jowl and neck exercise kit to exercise the following muscles: masseters, temporalis, pterygoids, digastric, depressor anguli oris, depressor labii inferioris, mentalis, platysma and suprahoid muscles: mylohyioid, hyoglossus, geniihyiod, genioglossus, Buccinator, Zygomaticus mayor, Zygomaticus minor, Risorius and Orbicularis oris. non-invasively and without the use of electronics. The jaw, jowl and neck exercise kit comprises instruments that allow the user to isolate and contract the face and neck muscles. These contractions cause the aforementioned muscles to be exercised in a manner to produce efficient and fast results. The jaw, jowl and neck exercise kit is comprised of instruments designed to target different muscles and to allow the user to gradually increase resistance and to improve the effect of the exercise.

11 Claims, 9 Drawing Sheets

FIG 5
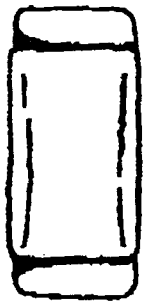
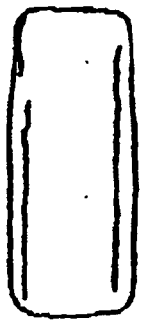
FIG 6

Fig. 14
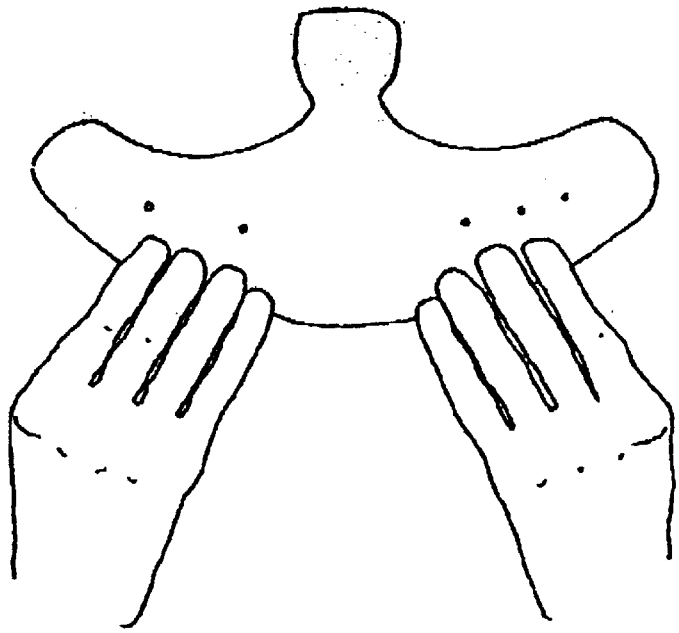
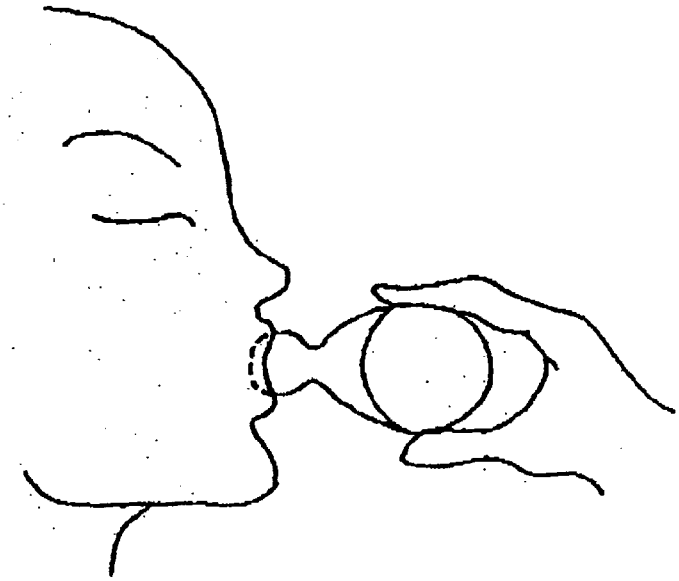
Fig. 15

MAXILLARY OCCLUSION MUSCLES-EXERCISER, CHEEK MUSCLES-EXERCISER, CHEEK AND MOUTH MUSCLES-EXERCISER

BACKGROUND OF THE INVENTION

1. Field of the Invention

The present invention relates to a kit comprising instruments as a means for exercising the jaw, jowl and neck muscles. More specifically, the present invention relates to a jaw, jowl and neck exercise kit comprising instruments as a means to maximize the efficiency of facial exercise by providing instruments which allow. the user to increase face and neck-muscle strength and thereby improve esthetic appearance.

2. Prior Art

Facial exercises have been shown to improve muscle tone, reduce subcutaneous fat, increase blood circulation, and can help improve esthetic appearance. Because of the nature of the jaw, jowl and neck muscles, facial and neck exercise alone produces minimal results because it is difficult to make the muscles respond properly. Thus, an extraordinary amount of facial exercise produces only minimal results. A jaw, jowl and neck muscles exercise kit comprising the maxillary occlusion instrument and cheek muscle exerciser is required to provide the user with an effective means of resistance to isolate and exercise the muscles of the jaw, jowl and neck to properly strengthen the muscles more effectively and faster than exercise alone. A jaw, jowl and neck muscles exercise kit comprising the maxillary occlusion instrument and cheek muscle exerciser is required to provide the user with a system designed to exercise the masseters, temporalis, pterygoids, digastric, depressor anguli oris, depressor anguli inferioris, mentalis, platysma and suprahoid muscles: mylohyioid, hyoglossus, geniiohyiod, genioglossus, Buccinator, Zygomaticus mayor, Zygomaticus minor, Risorius and Orbicularis oris.

SUMMARY OF THE INVENTION

The principal object of this invention is to provide a jaw, jowl and neck exercise kit comprised of instruments including a Maxillary Occlusion Muscles Exerciser and a Cheek Muscles Exerciser.

Another object of this invention is to provide a kit which includes instruments as a means of exercising the following muscles: masseters, temporalis, pterygoids, digastric, depressor anguli oris, depressor labii inferioris, mentalis, platysma and suprahoid muscles: mylohyioid, hyoglossus, geniiohyiod, genioglossus Buccinator, Zygomaticus mayor, Zygomaticus minor, Risorius and Orbicularis oris more efficiently than exercise or a single instrument alone.

Another object of this invention is to provide a jaw, jowl and neck exercise kit comprising instruments that do not require special fitting procedures or adjustments.

Another object of this invention is to provide a jaw, jowl and neck exercise kit that is comfortable and does not provide discomfort from straps or bands.

Another object of this invention is to provide a jaw, jowl and neck exercise kit that does not use springs or tension bars that might break.

Another object of this invention is to provide a jaw, jowl and neck exercise kit that does not require electronics.

Another object of this invention is to provide a jaw, jowl and neck exercise kit that benefits the deep muscles of the face and not just the upper layers of the skin to reduce muscular flabbiness.

Another object of this invention is to provide a jaw, jowl and neck exercise kit that allows the user to exercise each side of the mouth separately to increase effectiveness of exercise and obtain faster results.

Another object of this invention is to provide a jaw, jowl and neck exercise kit that offers more than one level of resistance.

These objects, as well as other objects which will become apparent from the discussion that follows, are accomplished by having jaw, jowl and neck exercise kit comprised of instruments made of hygienic materials suitable for placement in the mouth.

BRIEF DESCRIPTION OF THE DRAWINGS

Maxillary Occlusion Muscles—Exerciser

FIG. 5 shows a vertical view of the maxillary occlusion muscles exerciser instrument standing on its side facing the smaller extremity showing the difference in sizes between extremities;

FIG. 6 shows a vertical view of the maxillary occlusion muscles exerciser instrument standing on its side facing the larger extremity and obscuring the view of the smaller extremity;

FIG. 14 shows an aerial view from the front of how the cheek muscles exerciser instrument should be held in the hands;

FIG. 15 shows a side view of how the cheek muscles exerciser instrument should be placed in the mouth;

DETAILED DESCRIPTION OF THE INVENTION

Figure 1:
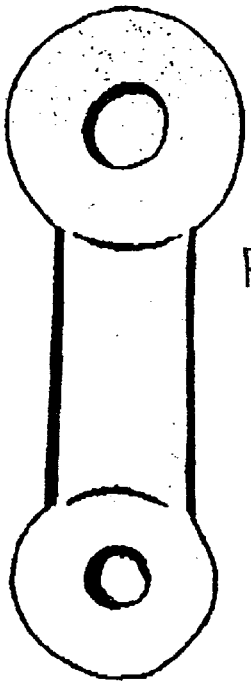
FIG. 1 shows an aerial view from the top of the maxillary occlusion muscles exerciser instrument showing the larger and smaller extremities and the shape of the segment joining them.

As shown in the drawings, the preferred jaw, jowl and neck exerciser kit in accordance with the present invention comprises instruments including a Maxillary Occlusion Muscles Exerciser, a Cheek Muscles Exerciser. A Cheek and Mouth Muscles Exerciser and other embodiments are possible. These instruments can be other sizes that would allow for comfortable adjustment to different mouth sizes.

Maxillary Occlusion Muscles Exerciser Instrument

Figure 2:
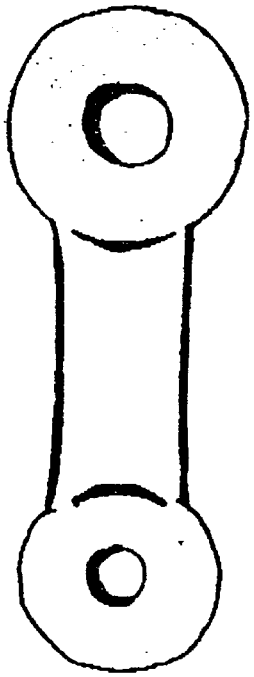
FIG. 2 shows aerial view from the bottom of the maxillary occlusion muscles exerciser instrument showing the larger and smaller extremities and the shape of the segment joining them.
Figure 3:
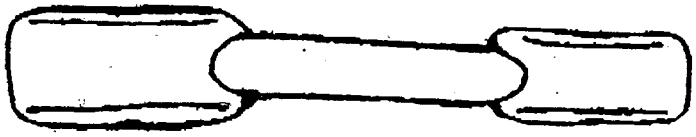
FIG. 3 shows a left side view of the maxillary occlusion muscles exerciser instrument showing the "I" shape and proportions of the extremities.
Figure 4:
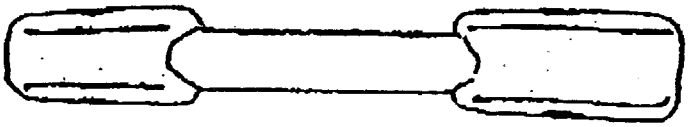
FIG. 4 shows a right side view of the maxillary occlusion muscles exerciser instrument showing the showing the "I" shape and proportions of the extremities.

FIG. 1 shows the maxillary occlusion instrument made of silicon or another resilient material: suitable for placement in the mouth having one larger and one smaller extremity joined by a central segment in a general "I" shape. FIGS. 1 and 2 show that both the larger and smaller extremities spherical or are circular having a donut shape with a circular opening in the center of the extremity.

Figure 7:
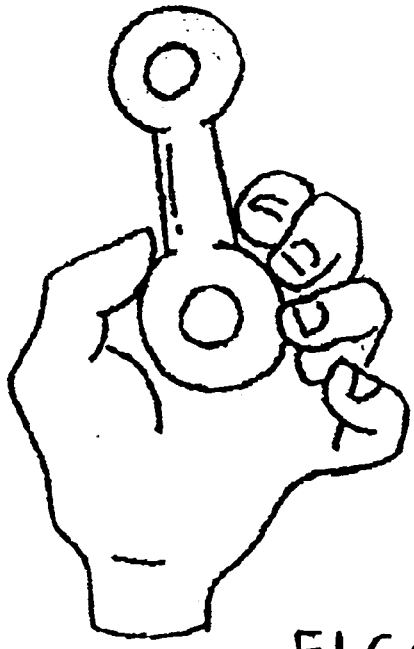
FIG. 7 shows a view of how the maxillary occlusion muscles exerciser instrument should be taken with either hand.

FIG. 7 shows how the maxillary occlusion instrument is grasped with the hand and the fingers placed touching the rectangular central strip and around perimeter of the extremity. The instrument is grasped by the hand ipsilateral to the side of the face and neck that the user wants to exercise. The user grasps the instrument by the larger extremity when less resistance is desired and grasps the instrument by the smaller extremity when more resistance is desired.

Figure 8:
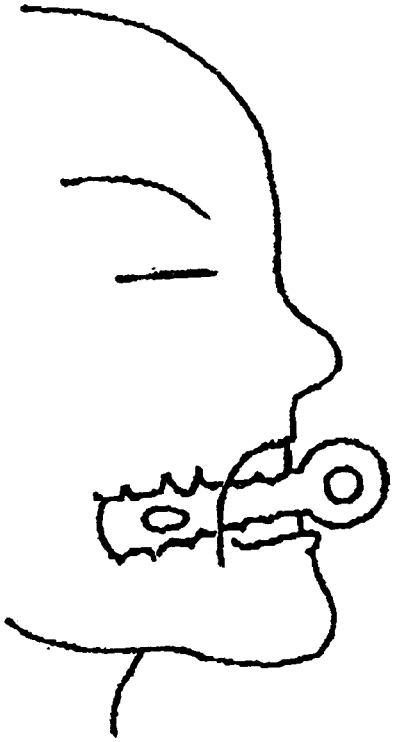
FIG. 8 shows a view of how the maxillary occlusion muscles exerciser instrument should be placed in the mouth.

FIG. 8 shows how one extremity is placed on the side of the mouth with the other extremity remaining outside the mouth. The user may also hold the other extremity outside the mouth with the hand. The user opens and closes the mouth by performing a biting motion. The biting motion causes the masseters, temporalis, pterygoids, digastric, depressor anguli oris, depressor labii inferioris, mentalis, ,platysma and suprahoid muscles: (mylohyioid, hyoglossus, geniiohyiod, genioglossus) to contract. The user should perform 20 to 40 biting motions. The user should then switch the instrument to the other side of the mouth in the same manner described above and perform an equal number of biting motions. After this exercise is completed, the user should switch to the Cheek Muscles Exerciser.

Cheek Muscles Exerciser Instrument

Figure 9:
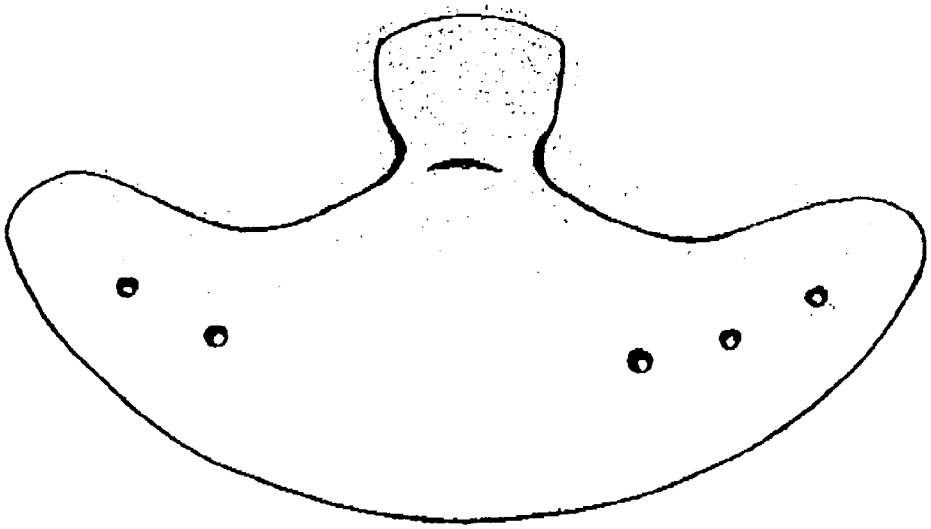
FIG. 9 shows an aerial view of the front of the cheek muscles exerciser instrument lying horizontally and made out of rigid ceramic, plastic or similar material suitable for placement in the mouth.

FIG. 9 shows the cheek muscles instrument made from plastic or ceramic with a plurality of holes on the front, having a general "T" shape with an enlarged end portion. The enlarged end portion includes right and left lateral parts.

Figure 10:
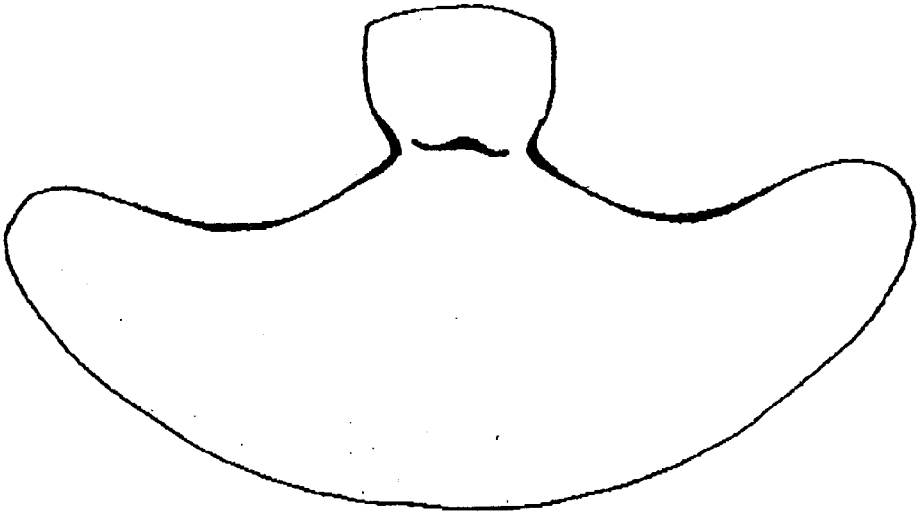
FIG. 10 shows an aerial view of the back of the cheek muscles exerciser instrument lying horizontally.

FIG. 10 shows that the underside of the cheek muscles instrument.

Figure 11:
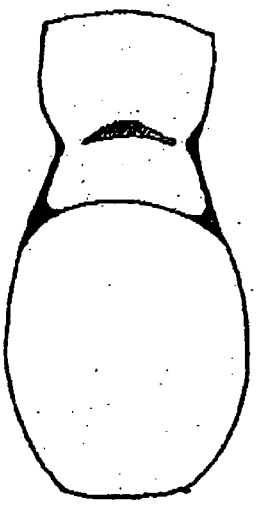
FIG. 11 shows a single side view of the cheek muscles exerciser instrument standing vertically.

FIG. 11 shows a single side view of the cheek muscles exerciser instrument standing vertically.

Figure 12:
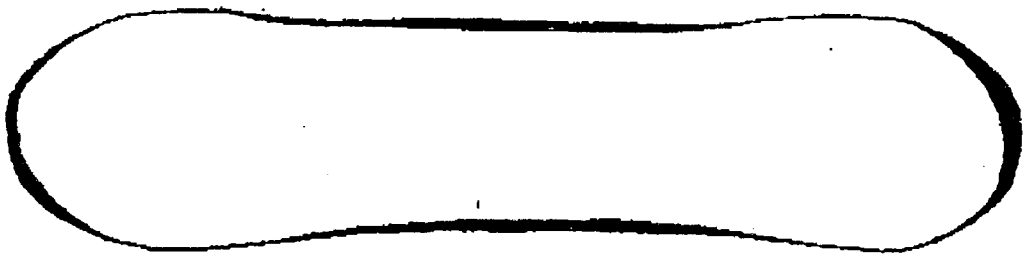
FIG. 12 shows an aerial view of the bottom of the cheek muscles exerciser instrument standing vertically and having a closed surface.

FIG. 12 shows that the area opposite the mouthpiece.

Figure 13:
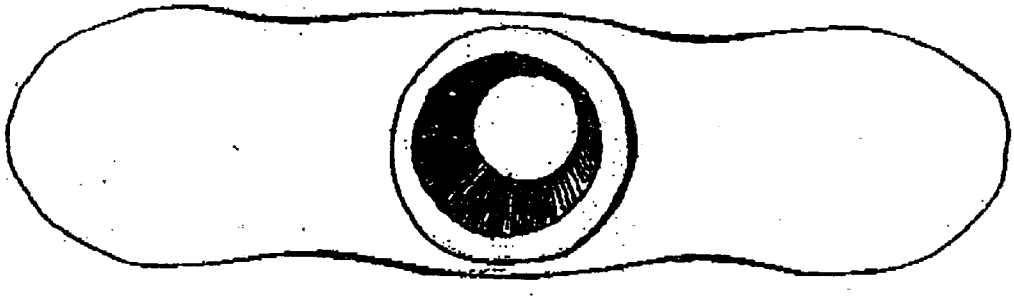
FIG. 13 shows an aerial view of the top of the cheek and muscles exerciser instrument standing vertically having a mouthpiece with a hole at the center.

FIG. 13 shows that the cheek muscles mouthpiece and interior are hollow.

The user grasps the cheek muscles instrument as shown in FIG. 14 and places the mouthpiece inside the mouth as shown in FIG. 15. The mouthpiece should be covered by the lips, and the user should blow strongly to force air to come through the holes shown in FIG. 9. Beginners should repeat this cycle about once every three to four seconds, initially performing 20 to 30 repetitions during a one to two minute exercise. More advance users should reduce cycle time to one second and the number of repetitions should increase to 50 to 60 per minute. The cheek muscles that are exercised are: Buccinator, Zygomaticus mayor, Zygomaticus minor, Risorius and Orbicularis oris.

Cheek and Mouth Muscles Exerciser Instrument

Figure 16:
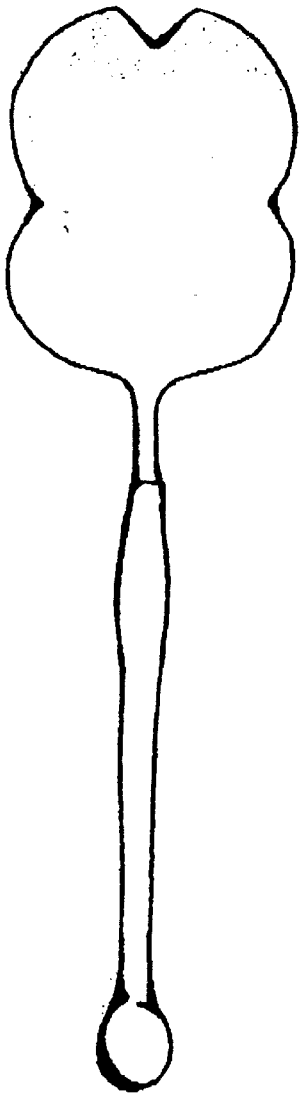
FIG. 16 shows an aerial view of the top of the Cheek and Mouth Muscles Exerciser instrument.
Figure 17:
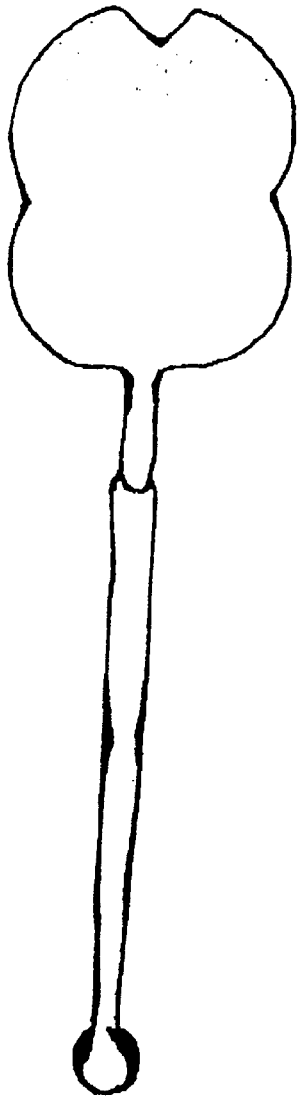
FIG. 17 shows an aerial view of the bottom of the Cheek and Mouth Muscles Exerciser instrument.

The Cheek and Mouth Muscles Instrument as shown in FIG. 16 is manufactured of stainless steel, hygienic plastic, or other material suitable for placement in the mouth having a thin handle and a wider principal part with a V-shaped notch. FIG. 17 shows a back view of the Cheek and Mouth Muscles instrument.

Figure 18:
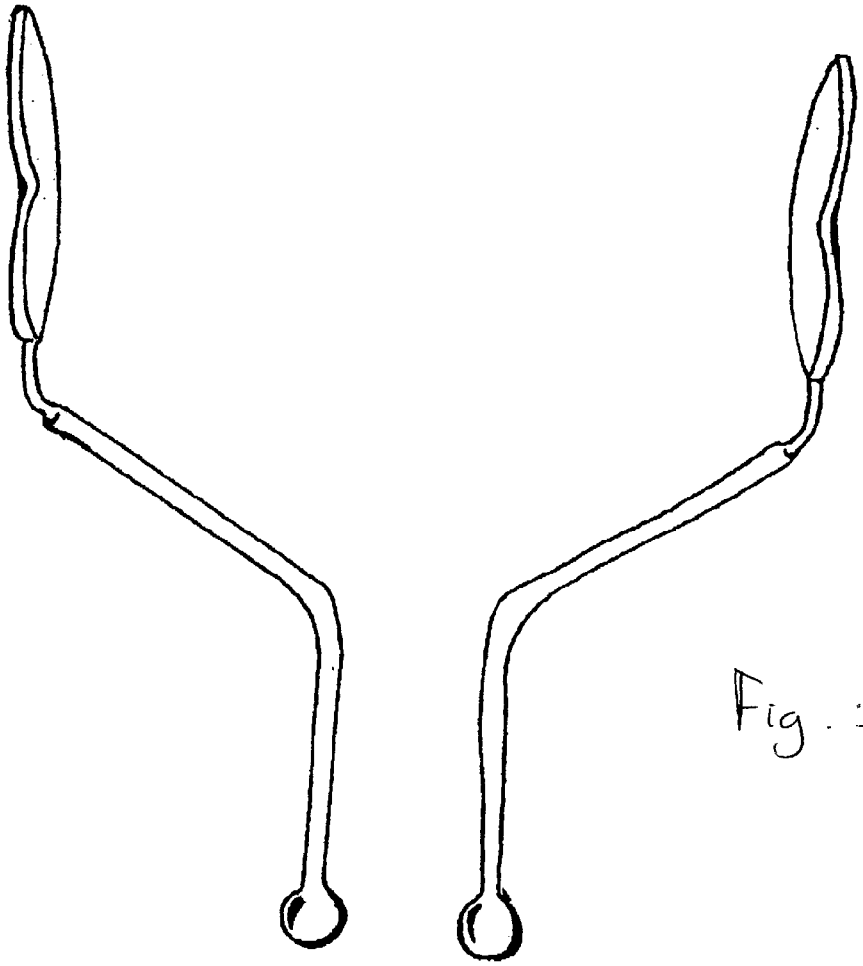
FIG. 18 shows side profiles of the Cheek and Mouth Muscles Exerciser instrument.

FIG. 18 shows that the handle of the Cheek and Mouth Muscles instrument is angled when it approaches the wider principal part.

Figure 19:
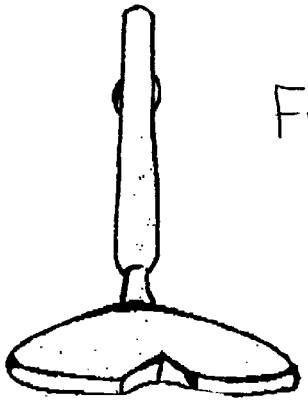
FIG. 19 shows a frontal view of the top of the Cheek and Mouth Muscles Exerciser instrument.
Figure 20:
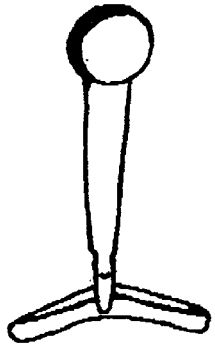
FIG. 20 shows a frontal view of the bottom of the Cheek and Mouth Muscles Exerciser instrument.

FIGS. 19 and 20 show how the top and bottom of the Cheek and Mouth Muscles instrument look from the front.

Figure 21:
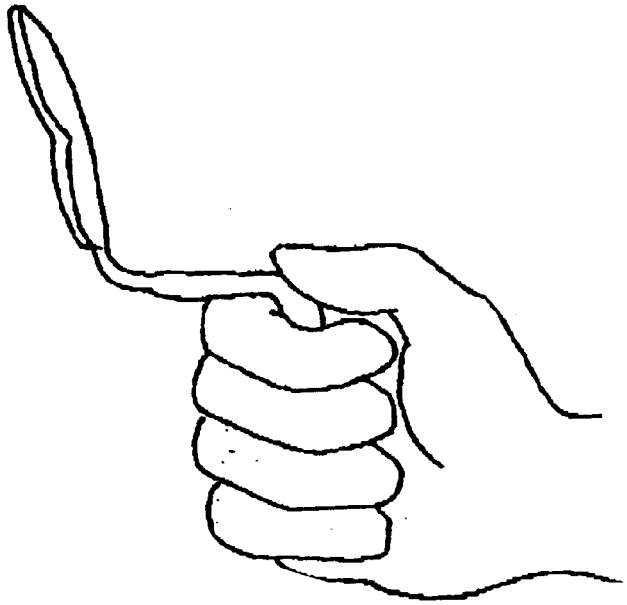
FIG. 21 shows a view of the suggested manner of how the Cheek and Mouth Muscles exerciser instrument may be grasped by the hands.
Figure 22:
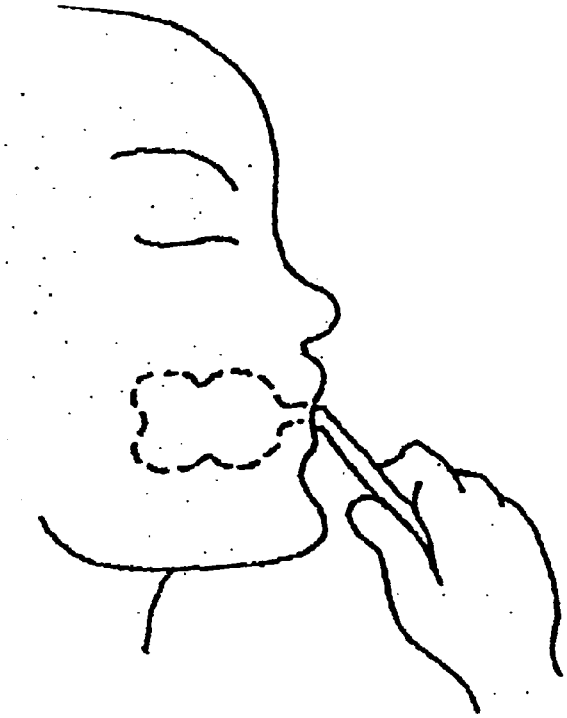
FIG. 22 shows a profile view of how the Cheek and Mouth Muscles exerciser instrument should be placed in the mouth.

The Cheek and Mouth Muscles instrument is grasped by the handle as shown in FIG. 21 by the hand ipsilateral to the side of the face and neck that the user wants to exercise. The wider principal part of the instrument is then placed inside the mouth resting horizontally against the inside wall of the cheek as shown in FIG. 22 and pushing the cheek outward. The user should then close the mouth with a kissing motion every 3–4 seconds for a total of 20 to 30 repetitions during a one to two minute period. After one the facial muscles strengthen the user should increase the number of repetitions to 50 to 60 per minute. After the exercise is performed, the user should move the Cheek and Mouth Muscles instrument to the other side of the mouth and repeat the exercise as described above. In this manner the Buccinator, Zygomaticus minor, Zygomaticus major, Orbicularis oris, Depressor anguli oris, Depressor anguli inferioris, Levator anguli oris, Levator anguli inferioris and Mentalis muscles are exercised. These exercises can be practiced once to twice a day.

Conclusion, Ramifications, and Scope of Invention

Although specific embodiments have been illustrated and described herein, it will be appreciated by those of ordinary skill in the art that any arrangement which is calculated to achieve the same purpose may be substituted for the specific embodiment shown.

This application is intended to cover any adaptations, modifications, substitutions or variations of the present invention. Therefore, it is manifestly intended that this invention be limited only by the claims and equivalents thereof.

I claim:

1. An oral jaw, jowl and neck exercise kit comprising:

a) a resilient maxillary occlusion exercise instrument having a substantially rectangular, planar segment with a first and a second end, a first circular extremity portion attached to the first end and having a first opening, and a second circular extremity portion attached to the second end and having a second opening, the first circular extremity portion having a larger diameter than the second circular extremity portion, and b) at least one rigid cheek and mouth exercise instrument, the at least one rigid cheek mouth exercise instrument having a handle with an end and a wider principal part attached to the end of the handle, the wider principal part having a width greater than the width of the handle, and c) a cheek muscle exercise instrument, wherein the first and second extremity portions of the maxillary occlusion exercise instrument, the wider principal part of the cheek and mouth exercise instrument and the cheek muscle exercise instrument are inserted into the mouth and adjacent the cheeks in order to exercise the jaw, jowl and neck muscles.

2. The jaw, jowl and neck exercise kit recited in claim 1, wherein the maxillary occlusion instrument is generally I-shaped.

3. The jaw, jowl and neck exercise kit recited in claim 1, wherein the at least one rigid cheek and mouth exercise instrument includes a pair of rigid cheek and mouth exercise instruments.

4. The jaw, jowl and neck exercise kit recited in claim 1, wherein the at least one cheek and mouth exercise instrument is made from a hygienic material.

5. The jaw, jowl and neck exercise kit recited in claim 4, wherein the hygienic material is made of stainless steel or plastic.

6. The jaw, jowl and neck exercise kit recited in claim 1, wherein the wider principal part of the at least one cheek and mouth exercise instrument includes a V-shaped notch.

7. The jaw, jowl and neck exercise kit recited in claim 1, wherein the handle of the at least one rigid cheek and mouth exercise instrument is angled.

8. The jaw, jowl and neck exercise kit recited in claim 1, wherein the cheek muscle exercise instrument has a generally T-shape and further includes a mouthpiece and an enlarged end portion, the enlarged end portion including right and left lateral parts and having a width greater than the width of the mouthpiece.

9. The jaw, jowl and neck exercise kit recited in claim 8, wherein the enlarged end portion included a plurality of holes.

10. The jaw, jowl and neck exercise kit recited in claim 1, wherein the cheek muscles exercise instrument is hollow.

11. The jaw, jowl and neck exercise kit recited in claim 1, wherein the cheek muscle instrument is made from plastic or ceramic.

* * * * *